US009360230B2

(12) United States Patent
Breed

(10) Patent No.: US 9,360,230 B2
(45) Date of Patent: Jun. 7, 2016

(54) AIR DUCT SEALING SYSTEM FOR OBSTRUCTING OR DIRECTING AIRFLOW THROUGH PORTIONS OF AN AIR DUCT SYSTEM

(71) Applicant: Richard Corey Breed, Austin, TX (US)

(72) Inventor: Richard Corey Breed, Austin, TX (US)

( * ) Notice: Subject to any disclaimer, the term of this patent is extended or adjusted under 35 U.S.C. 154(b) by 684 days.

(21) Appl. No.: 13/754,865

(22) Filed: Jan. 30, 2013

(65) Prior Publication Data

US 2014/0213173 A1 Jul. 31, 2014

Related U.S. Application Data

(63) Continuation-in-part of application No. 13/108,957, filed on May 16, 2011, now abandoned, which is a continuation-in-part of application No. 12/757,397, filed on Apr. 9, 2010, now abandoned.

(51) Int. Cl.

| | |
|---|---|
| ***F24F 7/00*** | (2006.01) |
| ***F24F 13/10*** | (2006.01) |
| ***F24F 13/20*** | (2006.01) |
| ***F24F 13/072*** | (2006.01) |
| ***F24F 13/08*** | (2006.01) |

(52) U.S. Cl.

CPC ..... *F24F 13/20* (2013.01); *F24F 13/072* (2013.01); *F24F 13/082* (2013.01); *Y10T 24/1498* (2015.01)

(58) Field of Classification Search

CPC ..... F24F 13/082; Y10T 24/1498

See application file for complete search history.

(56) References Cited

U.S. PATENT DOCUMENTS 2,834,278 A * 5/1958 Crute, Jr. ..... E04B 1/7076 454/276
3,130,659 A * 4/1964 Compton ..... E06B 7/02 454/276
4,502,368 A * 3/1985 Hempel ..... F24F 13/00 248/222.41
4,520,715 A * 6/1985 Coomes ..... F24F 13/00 454/284
4,617,702 A * 10/1986 Diederich, Jr. ..... B65D 63/1072 24/16 PB
4,964,438 A * 10/1990 Welty ..... F16L 55/11 126/319
5,192,244 A * 3/1993 Rose ..... F24F 13/08 454/276
5,213,543 A * 5/1993 Clarino ..... F24F 13/20 292/253
5,377,510 A * 1/1995 Smith ..... A61B 17/1327 128/878
5,425,674 A * 6/1995 Stach ..... F24F 13/20 454/299
5,479,984 A 1/1996 Easterbrook et al.

(Continued)

OTHER PUBLICATIONS

Office Action dated Oct. 2, 2012 in U.S. Appl. No. 12/757,397.

(Continued)

*Primary Examiner* — Steven B McAllister
*Assistant Examiner* — Jonathan Cotov

(57) ABSTRACT

The present invention discloses removable air duct sealing systems for obstructing and directing airflow through portions of an air duct system. Some systems include a support plate having an opening and a flexible connector having a catch and a tail, the catch for connecting the connector to an air duct system component and the tail for passing through the opening in the support plate. Some systems include a fastener connected to the support plate, the fastener being capable of interacting with the connector in dependence upon the positioning of the fastener. In some systems, the fastener has a catch capable of being configured in a position that prevents the fastener from moving in a direction relative to the flexible connector but will allow the fastener to move in another direction. Some systems also include a gasket for restricting airflow when the gasket is pressed toward the air duct system component.

8 Claims, 10 Drawing Sheets

(56) References Cited

U.S. PATENT DOCUMENTS

| | | | | |
|---|---|---|---|---|
| 6,105,908 | A * | 8/2000 | Kraus | F16L 3/137 24/16 PB |
| 6,347,435 | B1 * | 2/2002 | Davignon | B65D 63/1063 24/16 PB |
| 6,588,169 | B2 * | 7/2003 | Sarver | E04B 1/41 24/16 R |
| 6,640,395 | B2 | 11/2003 | Bush | |
| 6,767,279 | B1 * | 7/2004 | Serrano | F24F 13/082 454/270 |
| 6,832,951 | B2 | 12/2004 | Orendorff | |
| 7,022,011 | B1 * | 4/2006 | Rickman | F24F 13/02 454/306 |
| 8,292,708 | B2 * | 10/2012 | Viggers | F24F 13/20 454/275 |
| 8,499,497 | B1 * | 8/2013 | Hugueley | F24F 13/082 49/463 |
| 2002/0069599 | A1 * | 6/2002 | Dhallan | F24F 13/082 52/302.1 |
| 2004/0023005 | A1 * | 2/2004 | Perez | F24F 13/20 428/192 |
| 2005/0086889 | A1 * | 4/2005 | Shock | E04G 23/0203 52/514 |
| 2005/0186900 | A1 * | 8/2005 | Janesky | E04B 1/7076 454/276 |
| 2009/0302544 | A1 * | 12/2009 | Pugh, Jr. | F24F 13/082 277/312 |
| 2010/0207407 | A1 * | 8/2010 | Walker, Jr. | B01D 46/4227 294/210 |
| 2010/0233953 | A1 * | 9/2010 | Mavroudis | F24F 13/084 454/276 |
| 2011/0146162 | A1 * | 6/2011 | Kilhams | B08B 15/00 49/463 |
| 2013/0331023 | A1 * | 12/2013 | Yalmeh | F24F 13/082 454/275 |

OTHER PUBLICATIONS

Office Action dated Sep. 24, 2013 in U.S. Appl. No. 13/108,957.

* cited by examiner

AIR DUCT SEALING SYSTEM FOR OBSTRUCTING OR DIRECTING AIRFLOW THROUGH PORTIONS OF AN AIR DUCT SYSTEM

This application claims the benefit of and is a continuation-in-part of Non-Provisional application Ser. No. 12/757,397 entitled "Air Vent Cover For Use In Testing Air Leakage Of An Air Duct System" and filed on Apr. 9, 2010, which is incorporated herein by reference in its entirety.

This application claims the benefit of and is a continuation-in-part of Non-Provisional application Ser. No. 13/108,957 entitled "Air Duct Blocking Device For Obstructing Airflow Through Portions Of An Air Duct System" and filed on May 16, 2011, which is incorporated herein by reference in its entirety.

TECHNICAL FIELD

The present invention relates to the field of removable air duct sealing systems for obstructing or directing airflow through portions of an air duct system.

BACKGROUND ART

As the trend to conserve energy continues, more individuals are demanding and more governmental entities are mandating that houses and commercial facilities undergo periodic energy audits. An energy audit is a service where a building structure's energy efficiency is evaluated by a person using professional equipment as blower door and infra-red cameras), with the aim to suggest the best ways to improve energy efficiency in heating and cooling the structure.

An energy audit involves recording various characteristics of the building envelope including the walls, ceilings, floors, doors, windows, and skylights. For each of these components the area and resistance to heat flow (R-value) is measured or estimated. The leakage rate or infiltration of air through the building envelope is of concern and is strongly affected by window construction and quality of door seals such as weather stripping. The goal of an audit is to quantify the building's overall thermal performance. The audit may also assess the efficiency, physical condition, and programming of mechanical systems such as the heating, ventilation, air conditioning (HVAC) equipment, and thermostat.

Leaks in an air duct system often account for a large percentage of energy being wasted in a typical home. In a residence, the percentage of air that escapes out of an air duct system due to leaks, on average, is approximately twenty-five percent (25%). Given that in some areas of the country, sixty percent (60%) to seventy percent (70%) of the cost of a household's monthly utilities bill is due to the operation of the HVAC system, air leakage in an air duct system may represent a significant waste of both monetary and energy resources.

Measuring the leakage in an air duct system is generally the most time consuming portion of a home energy audit. In fact, as much as fifty percent (50%) of the time required to perform a home energy audit is consumed in testing air leakage of an air duct system. The majority of that time is spent sealing off the various air vents so that the air duct system can be pressurized or depressurized to measure the air leaks.

Current methods of sealing off the air vents involve the use of a special adhesive tape that adheres to the face of an air vent. There are, however, certain drawbacks to the use of this adhesive tape. Applying and removing the adhesive tape to all of the air vents takes a significant amount of time because the adhesive tape is cumbersome and awkward to use. Commonly, the tape sticks to itself and those pieces have to be thrown away unused. The tape is generally stored in bulky spools that are heavy and difficult to maneuver. When the tape is removed from the spools, it can generate an extremely loud noise that may wake up members of a home that are asleep during the day, such as, for example a baby or elderly person taking a nap, or be disruptive to ongoing business concerns.

Another drawback is that the tape does not provide the best seal possible for the air duct system. Even after the tape is applied to the air vent, air may still enter and leave the air duct system beneath the face of the air vent that touches the wall or ceilings surface because the tape only blocks the openings of the air vent on the face of the air vent. The tape does not block openings between the air vent and surface on which the air vent is installed. An additional drawback occurs when the tape is removed. Because the tape uses a strong adhesive, damage often occurs to the wall, ceiling, or air vent when the tape is removed.

Many audits of a building's HVAC system occur while the building is still under construction. For example, prior to the sheet rock being installed in a building, technicians will test an HVAC system for leaks and energy efficiency to allow for easy repair or adjustments prior the installation of surfaces that may hinder such repair or adjustment efforts. During subsequent construction, however, debris, dust, and dirt have the potential to enter into an HVAC system through the air vent boots and other openings in an HVAC system. Currently, construction workers attempt to prevent such debris from entering the HVAC system by taping cardboard to the HVAC openings or stuffing material into the openings to block the debris from entering. None of the current solutions serve to provide an effective seal, however, to protect the HVAC system during the final stages of construction.

SUMMARY OF INVENTION

The present invention discloses a removable air duct sealing system for obstructing airflow through portions of an air duct system. A removable air duct sealing system according to embodiments of the present invention may include a support plate having a first side and a second side. The support plate in such embodiments may have an opening extending through the support plate from the first side to the second side. A removable air duct sealing system according to embodiments of the present invention may also include a flexible connector. This flexible connector may have a catch and a tail. The catch of such a flexible connector may be capable of connecting the flexible connector to an air duct system component. The tail may be capable of passing through the opening in the support plate. A removable air duct sealing system according to embodiments of the present invention may also include a fastener operatively connected to the support plate, the fastener having a fastener catch. The fastener may be capable of interacting with the tail of the flexible connector in dependence upon the positioning of the fastener catch. The fastener catch may be capable of being configured in a first position that prevents the fastener from moving in a first direction along the tail relative to the flexible connector. The fastener catch may be capable of being configured in a second position that allows the fastener to move in the first direction along the tail relative to the flexible connector. Further, the fastener catch may be capable of allowing the fastener to move in a second direction along the tail relative to the flexible connector when configured in the first position. A removable air duct sealing system according to embodiments of the present invention may include a gasket configured on the first side of the support plate. The gasket may be capable of restricting airflow between the support plate and an air duct system component when the gasket is pressed toward the air duct system component.

In other embodiments, a removable air duct sealing system may include a cover assembly that has a first side and a second side. The cover assembly may have an opening extending through the cover assembly from the first side to the second side and be capable of restricting airflow between the cover assembly and an air duct system component when the cover assembly is pressed toward the air duct system component. A removable air duct sealing system according to embodiments of the present invention may also include a flexible connector that has a catch and a tail. The catch may be capable of connecting the flexible connector to the air duct system component, and the tail of the flexible connector may include a various notches. The tail may be capable of passing through the opening in the cover assembly. The cover assembly of some embodiments may include a fastener that may be capable of operatoing together with the tail of the flexible connector as a ratchet. The fastener may include a ratchet pawl that is capable of engaging at least one of the various notches of the tail of the flexible connector to prevent the fastener from moving in a first direction along the tail relative to the flexible connector when the ratchet pawl is configured in a particular position. The ratchet pawl may be capable of disengaging from the various notches of the tail of the flexible connector to allow the fastener to move in the direction along the tail relative to the flexible connector when the ratchet pawl is configured in a another position.

Still further, in some removable air duct sealing systems according to embodiments of the present invention may include a support plate having a first side and a second side. The support plate may have a first opening, a second opening, and a third opening—each of the first opening, the second opening, and the third opening extending through the support plate from the first side to the second side. A removable air duct sealing systems according to embodiments of the present invention may include a first flexible connector. The first flexible connector may have a first catch and a first tail—the first catch capable of connecting the first flexible connector to an air duct system component, and the first tail capable of passing through the first opening in the support plate. The first fastener may be operatively connected to the support plate. The first fastener may have a first fastener catch, and the first fastener may be capable of interacting with the first tail of the first flexible connector in dependence upon the positioning of the first fastener catch. The first fastener catch may be capable of being configured in a first position that prevents the first fastener from moving in a first direction along the first tail relative to the first flexible connector. The first fastener catch may be capable of being configured in a second position that allows the first fastener to move in the first direction along the first tail relative to the first flexible connector. A removable air duct sealing systems according to embodiments of the present invention may also include a second flexible connector that has a second catch and a second tail. The second catch may be capable of connecting the second flexible connector to the air duct system component, and the second tail may be capable of passing through the second opening in the support plate. A removable air duct sealing systems according to embodiments of the present invention may similarly include a second fastener operatively connected to the support plate and have a second fastener catch. The second fastener may be capable of interacting with the second tail of the second flexible connector in dependence upon the positioning of the second fastener catch. The second fastener catch may be capable of being configured in a third position that prevents the second fastener from moving in a third direction along the second tail relative to the second flexible connector, and the second fastener catch may be capable of being configured in a fourth position that allows the second fastener to move in the fourth direction along the second tail relative to the second flexible connector. A removable air duct sealing systems according to embodiments of the present invention may also include a gasket configured on the first side of the support plate that restricts air flow between the support plate and the air duct system component when the gasket is pressed toward the air duct system component. A removable air duct sealing systems according to embodiments of the present invention may further include a sleeve positioned at the third opening that extends away from the support plate on the second side. The sleeve may be capable of connecting to an air duct hose.

BRIEF DESCRIPTION OF DRAWINGS

The accompanying drawings, which are incorporated in and constitute a part of this specification, illustrate an implementation of apparatus and methods consistent with the present invention and, together with the detailed description, serve to explain advantages and principles consistent with the invention. In the drawings, FIG. 1 sets forth a drawing illustrating a perspective, exploded view of an exemplary removable air duct sealing system for obstructing airflow through portions of an air duct system according to embodiments of the present invention.

DESCRIPTION OF EMBODIMENTS

Figure 1:
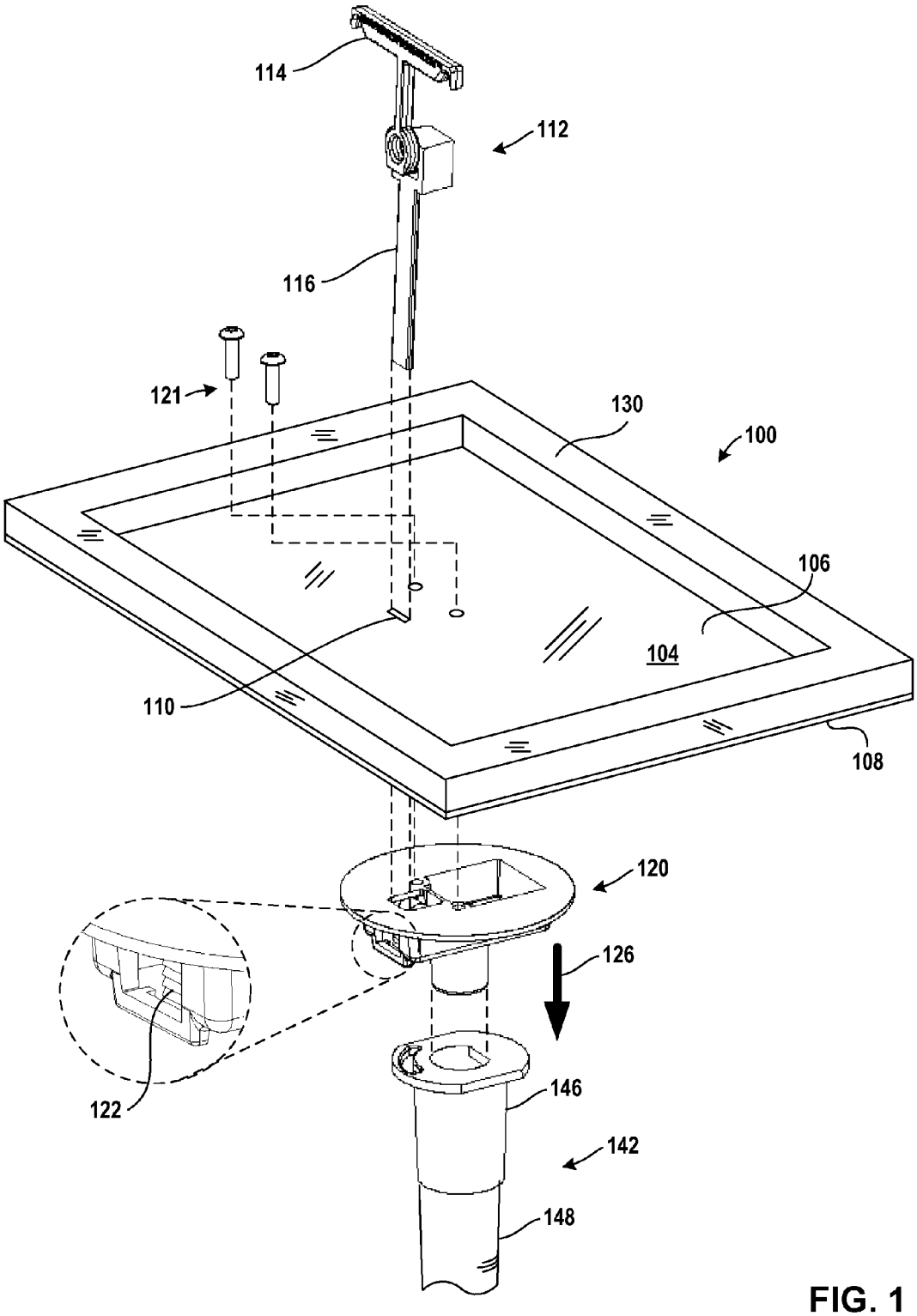

Exemplary embodiments of air duct blocking devices for obstructing airflow through portions of an air duct system are described herein with reference to the accompanying drawings, beginning with FIG. 1. FIG. 1 sets forth a drawing illustrating a perspective, exploded view of an exemplary removable air duct sealing system (100) for obstructing airflow through portions of an air duct system according to embodiments of the present invention. Air duct systems are used in heating, ventilation, and air conditioning (HVAC) to deliver, circulate, or remove air using supply, return, or exhaust airflows. Air duct systems, therefore, are one method of ensuring acceptable indoor air quality as well as thermal comfort.

Though air duct systems vary from one installation to another, many air duct system share a common set of components. Air duct systems generally include an air handler unit that may be composed of a blower or fan, heating or cooling elements, filters, humidifier, mixing chamber, heat recovery device, controls, and vibration isolators. In addition, air duct systems typically include other components such as networks of plenums, ducts, and boots that direct airflow between the air handler unit and various air vents registers used to supply air to or return air from the spaces served by the air duct system. Readers will note that much of the air vent system is omitted from the Figures for clarity as these components are well known and understood by those of skill in the art.

To detect leaks in an air duct system, a technician will typically pressurize or depressurize the air duct system and measure the changes in air pressure throughout the system over time. Exemplary removable air duct sealing systems according to embodiments of the present invention are useful in obstructing airflow through portions of an air duct system. Exemplary removable air duct sealing systems according to embodiments of the present invention typically connect to an air duct system component such as, for example, an air vent register or grill or an air vent register boot. An air vent register is an opening, typically forming a grill, in an air duct system that serves to supply air to or return air from a space served by the air duct system. A register boot is a device that provides a physical interface between an air duct and an air vent register. Those of skill in the art often may collectively refer to an "air vent register" and "register boot" as an air diffuser, an air grate, or a terminal unit.

Exemplary removable air duct sealing systems according to embodiments of the present invention may be placed over the air vent register or register boot to create a seal for inhibiting air flow through the register or boot, and consequently a portion of the HVAC system, while testing air leakage of the air duct system. The air may attempt to flow through the air vent register or register boot due to either pressurization or depressurization of the air duct system during the leak testing process. Systems used to pressurize or depressurize an air duct system are known to those of skill in the art and may include, for example, the Minneapolis Duct Blaster® or the Retrotec Duct Testing Blower System.

In FIG. 1, the exemplary removable air duct sealing system (100) for obstructing airflow through portions of an air duct system according to embodiments of the present invention includes a support plate (104). The support plate (104) of FIG. 1 has first side (106) and a second side (108). The support plate (104) also has an opening (110) extending through the support plate (104) from the first side (106) to the second side (108). The support plate (104) may be formed out of a variety of materials, including but not limited to, metal, carbon-composite, polyurethane, plastic, harden rubber, or any other material as will occur to those of skill in the art.

The exemplary removable air duct sealing system (100) of FIG. 1 also includes a flexible connector (112). The flexible connector (112) in the example of FIG. 1 has a catch (114) and a tail (116). The catch (114) is capable of connecting the flexible connector (112) to an air duct system component such as, for example, an air vent register, a register boot, or any other air duct system component as will occur to those of skill in the art. The tail (116) of FIG. 1 is capable of passing through the opening (110) in the support plate (104). Readers will note that the use of a hook in FIG. 1 is for example only, not for limitation. Other catch components for removeably attaching the flexible connector to an air duct system component as will occur to those of skill in the art may also be used such as a clip, claw, or other fastener. Preferably, though not required, the flexible connector is configured for easy attachment and detachment using one hand while holding the cover portion with the other hand. In other embodiment, it may be preferable to use a remote actuator to install and remove a removable air duct sealing system according to embodiments of the present invention. Similarly, the tail (116) in the example of FIG. 116 is implemented as a zip tie, but other structures could be utilizes as will occur to those of skill in the art such as, for examples, a circular tube with divots, as well as others.

The flexible nature of the flexible connector (112) in FIG. 1 facilitates quick and easy attachment to and detachment from an air duct system component. A flexible connector provides certain advantages over a rigid connector, which is often used in long-term or permanently installed covers. Rigid connectors, such as those fashioned from a system of nuts and bolts, are cumbersome and more time-consuming to attach and detach because the air vent cover must be precisely placed in the proper orientation for a rigid connector to connect with the air vent. For example, when using a rigid connector made up of a bolt through the air vent cover, typically the air vent cover has to be lined up with the connection point on the air vent. After lining up the air vent cover, however, the air vent cover often blocks or covers the connection point for the rigid connector on the air vent, thereby enhancing the difficulty associated with making the connection between the rigid connector and the collar of the register boot. When using a flexible connector, however, there is no requirement that the air duct sealing system be aligned initially with the air vent register or other component when attaching the connector because the flexible connector can bend or twist in the manner needed to quickly and easily connect to the air vent.

In FIG. 1, the exemplary removable air duct sealing system (100) includes a fastener (120). In FIG. 1, the fastener (120) is capable of adjusting the amount of a flexible connector that extends through the support plate (104) by operating the fastener (120) and sliding a flexible connector (112) through the fastener (120) to increase or decrease the amount of a flexible connector (112) extending through the support plate (104). By increasing the length of a flexible connector extending through the support plate (104), enough slack is provided in the flexible connector of FIG. 1 to permit fast, easy attachment of the flexible connector to an air duct system component such as, for example, an air vent register, register boot, plenum, duct joint, and so on. Then, decreasing the length of a flexible connector extending through the support plate allows the body of the air duct sealing system (100) to be secured against the air duct system component thereby obstructing airflow through a portion of the air duct system. Conversely, the body of the air duct sealing system may be easily removed by increasing the length of the flexible connector extending through the support plate (104) to provide enough slack in the flexible connector of FIG. 1 to permit fast, easy detachment of the flexible connector from the air duct system component.

The fastener (120) of FIG. 1 is operatively connected to the support plate (104) through screws (121). The fastener (120) of FIG. 1 has a fastener catch (122). The fastener capable (120) of FIG. 1 is capable of interacting with the tail (116) of the flexible connector (112) in dependence upon the positioning of the fastener catch (122). When the fastener catch (122) of FIG. 1 is in a position pressed against the tail (116) of the flexible connector (120), the fastener catch (122) prevents the fastener (120) from moving in a direction (126) along the tail (116) away from the catch (114) relative to the flexible connector (112). When the fastener catch (122) of FIG. 1 is in a position pushed away from the tail (116) of the flexible connector (112), the fastener catch (122) allows the fastener (120) to move in the direction (126) along the tail (116) away from the catch (114) relative to the flexible connector (112).

The exemplary removable air duct sealing system (100) of FIG. 1 also includes a gasket (130) configured on the first side (106) of the support plate (104). The gasket (130) of FIG. 1 is capable of restricting airflow between the support plate (104) and the air duct component to which the flexible connector (112) is connected when the gasket (130) is pressed toward the air duct component. The gasket (130) in the example of FIG. 1 is configure around the perimeter of the support plate (104), but one of skill in the art will recognize that this is for explanation only, not for limitation. Gaskets in some embodiments of the present invention may be substantially planar to fill almost the entire surface of the support plate, while gaskets in other embodiments may be much larger and more voluminous that the support plate to provide adequate sealing for large air duct components.

A gasket is a mechanical seal that fills the space between two mating surfaces. Gaskets allow "less-than-perfect" mating surfaces to seal by filling in irregularities of the mating surfaces. For example, use of the gasket (130) helps create a seal around the edges of an air duct component because the gasket (130) may engulf portions of the component when the gasket (130) is pressed against the sir duct component. Also, for uses when the air duct sealing system (100) is used to a seal a register boot with the air vent register installed, the gasket of may help the air duct sealing system seal against rough surface such as an interior ceiling or wall with a popcorn texture or other rough texture or even the louvers of the register itself. In this manner, a gasket blocks the flow of air between the inside and outside of the register boot while under compression. The gasket may be formed from a variety of materials as will occur to those of skill in the art, including, for example, foam, rubber, nylon, or plastic. When formed from material such as foam, readers will note that there are two types of foam that could be used to create a gasket according to embodiments of the present invention—open-cell foam and closed-cell foam.

In open-cell foam, the cell walls, or surfaces of the bubbles, are broken and air fills all of the spaces in the material. In this manner, open-cell foam creates a permeable barrier that may allow air to flow through it when uncompressed. When compressed, however, the open-cell foam may provide enough of a barrier to serve as a seal. The open-cell nature makes the foam soft or weak, as if it were made of broken balloons or soft toy rubber balls. The insulation value of this foam is related to the insulation value of the calm air inside the matrix of broken cells.

In closed-cell foam, most of the cells or bubbles in the foam are not broken; they resemble inflated balloons or soccer balls, piled together in a compact configuration. This makes the closed-cell foam strong or rigid because the bubbles are strong enough to withstand high-pressure. Although closed-cell foam is rigid, it has varying degrees of hardness, depending on its density. Because the cell walls of closed-cell foam are not generally broken, closed-cell foam provides greater resistance to air leakage than that of open-celled foam.

In FIG. 1, the exemplary removable air duct sealing system (100) includes a remote actuator (142). The exemplary remote actuator (142) of FIG. 1 is capable of allowing a technician or other user to press the gasket (130), through the support plate (104) and fastener (120), toward the air duct component to which the flexible connector (112) is connected when the remote actuator (142) is engaged with the fastener (120). In FIG. 1, the remote actuator (142) includes an actuator head (146) and an extension rod (148). The remote actuator (142) of FIG. 1 is configured to allow the user to selectively place the fastener catch (122) in either the position of being pressed against the tail (116) of the flexible connector (112) or the position of being pushed away from the tail (116) of the flexible connector (112) based on the how the user positions the remote actuator (142) relative to the fastener catch (122) when the remote actuator (142) is engaged with the fastener (120).

Figure 2A:
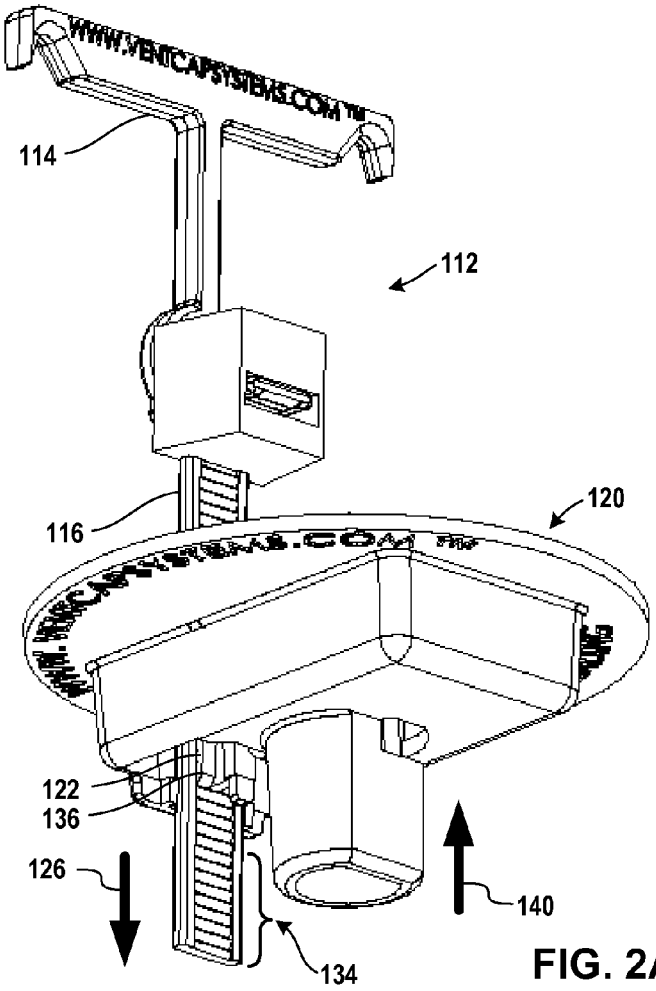
FIG. 2A sets forth a drawing illustrating the exemplary fastener and the exemplary flexible connector useful in the removable air duct sealing system of FIG. 1 for obstructing airflow through portions of an air duct system according to embodiments of the present invention.
Figure 2B:
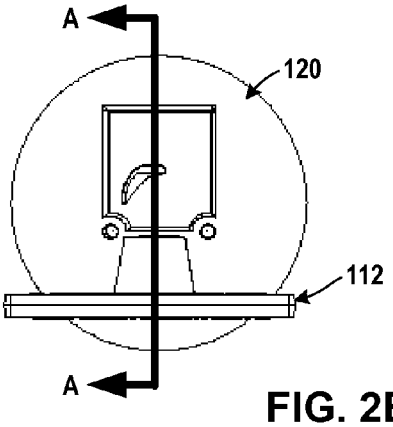
FIG. 2B sets forth a drawing illustrating the exemplary fastener and the exemplary flexible connector useful in the removable air duct sealing system of FIG. 1 for obstructing airflow through portions of an air duct system according to embodiments of the present invention.
Figure 2C:
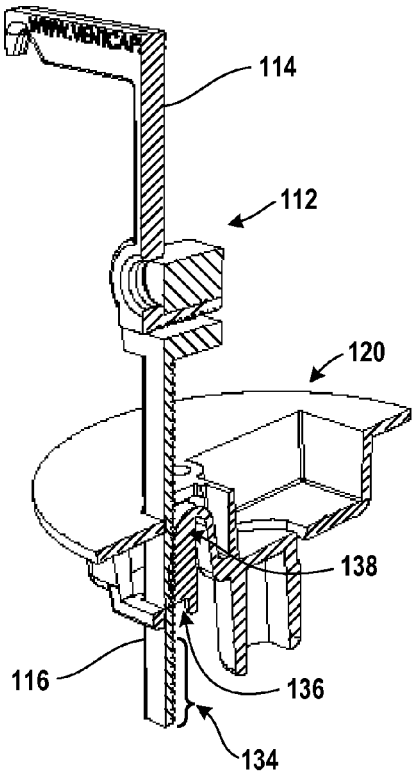
FIG. 2C sets forth a drawing illustrating the exemplary fastener and the exemplary flexible connector useful in the removable air duct sealing system of FIG. 1 for obstructing airflow through portions of an air duct system according to embodiments of the present invention.

FIG. 2A-C set forth drawings illustrating the exemplary fastener (120) and the exemplary flexible connector (112) useful in the removable air duct sealing system (100) of FIG. 1 for obstructing airflow through portions of an air duct system according to embodiments of the present invention. The other components of the removable air duct sealing system (100) of FIG. 1 are omitted from FIGS. 2A-C for clarity. FIG. 2A illustrates how the fastener catch (122) and the tail (116) are capable of operating together as a ratchet when the two components are engaged. The tail (116) of the flexible connector (112) shown in FIG. 2 includes notches (134). The fastener catch (122) of FIG. 2A is implemented as a ratchet pawl (136) capable of engaging at least one of the notches (134) to prevent the fastener (120) from moving in the direction (126) along the tail (116) away from the catch (114) relative to the flexible connector (112). Because the fastener catch (122) and the tail (116) of the flexible connector (112) of FIG. 2A operate together as ratchet, the fastener catch (122) allows the fastener (120) to move in another direction (140) along the tail (116) toward the catch (114) relative to the flexible connector (112) when configured in this position.

FIG. 2B illustrate the top view of the exemplary fastener (120) and the flexible connector (112) useful in the removable air duct sealing system (100) of FIG. 1 for obstructing airflow through portions of an air duct system according to embodiments of the present invention. FIG. 2C shows cross-section 'A' from FIG. 2B. FIG. 2C shows the ratchet pawl (136) engaging one of the notches (134) to prevent the fastener (120) from moving in the direction (126) along the tail (116) away from the catch (114) relative to the flexible connector (112).

In the example of FIGS. 2A-C, the fastener (120) includes a cantilever spring (138) operatively coupled to the ratchet pawl (136). The cantilever spring (138) of FIGS. 2A-C is under less tension when the ratchet pawl (136) is configured in a position pressed up against the tail (116) of the flexible connector (112) than when the ratchet pawl (136) is configured in a position away from the tail (116) of the flexible connector (112). In this way, the ratchet pawl (136) of FIGS. 2A-C is configured to press into the space where the tail (116) passes through the exemplary fastener (120), thereby allowing the cantilever spring (138) to hold the fastener catch (122) in position against the tail (116) of the flexible connector (112).

Figure 3A:
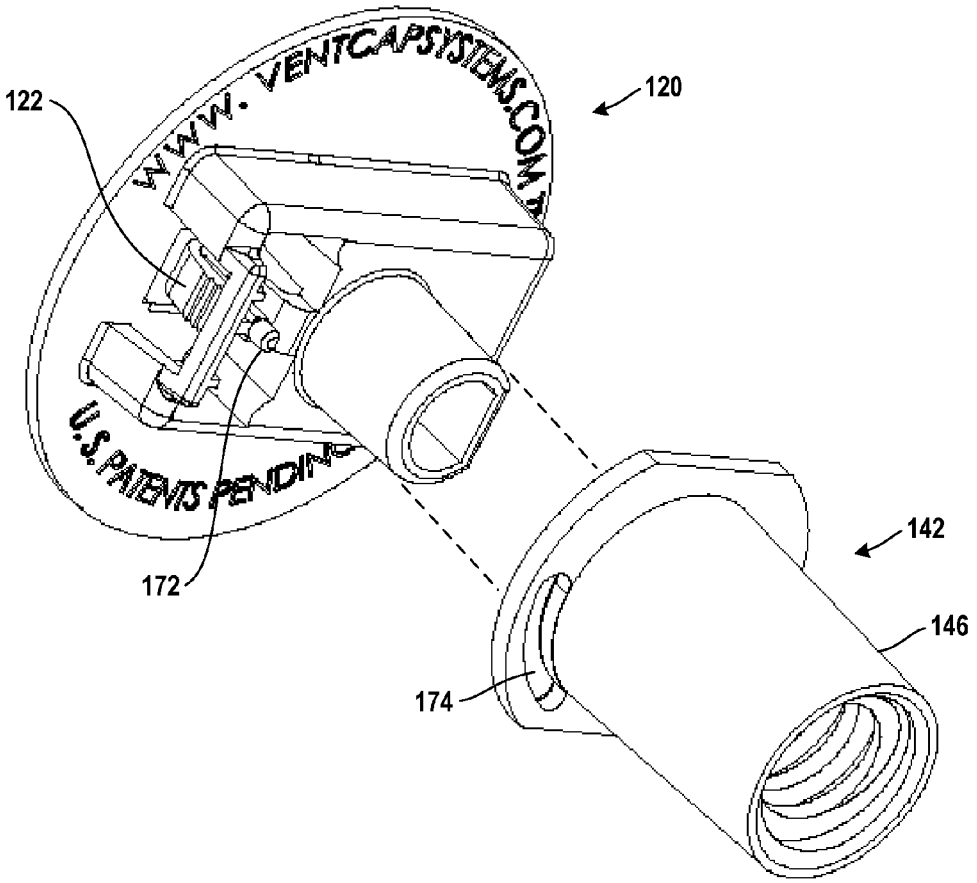
FIG. 3A sets forth a drawing illustrating the exemplary fastener and the exemplary remote actuator useful in the removable air duct sealing system of FIG. 1 for obstructing airflow through portions of an air duct system according to embodiments of the present invention.
Figure 3B:
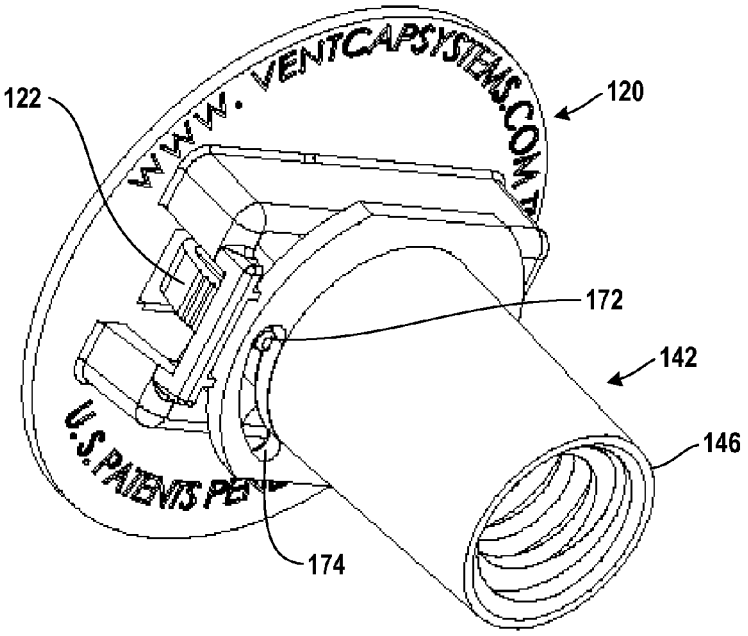
FIG. 3B sets forth a drawing illustrating the exemplary fastener and the exemplary remote actuator useful in the removable air duct sealing system of FIG. 1 for obstructing airflow through portions of an air duct system according to embodiments of the present invention.

As mentioned above, the remote actuator (142) of FIG. 1 is configured to allow the user to selectively place the fastener catch (122) in either the position of being pressed against the tail (116) of the flexible connector (112) or the position of being pushed away from the tail (116) of the flexible connector (112) based on the how the user positions the remote actuator (142) relative to the fastener catch (122) when the remote actuator (142) is engaged with the fastener (120). For further explanation, consider FIGS. 3A-B that set forth drawings illustrating the exemplary fastener (120) and the exemplary remote actuator (142) useful in the removable air duct sealing system (100) of FIG. 1 for obstructing airflow through portions of an air duct system according to embodiments of the present invention. The other components of the removable air duct sealing system (100) of FIG. 1 are omitted from FIGS. 3A-B for clarity. In FIGS. 3A-B, the remote actuator (142) includes the actuation head (146) and the extension rod (not shown), but the extension rod is not shown.

In FIGS. 3A-B, the remote actuator (142) is configured to allow a user to toggle the fastener catch (122) between a first position and a second position by rotating the remote actuator (142) relative to the fastener catch (122) when the remote actuator (142) is engaged with the fastener (120). For purposes of the example of FIGS. 3A-B, the first position is a position in which the fastener catch (122) is pressed into the region in which the tail (116 on FIG. 1) of a flexible connecter (112 on FIG. 1) occupies when engaged with the fastener (120), and the second position is a position in which the fastener catch (122) is pushed away from the region in which the tail (116 on FIG. 1) of a flexible connecter (112 on FIG. 1) occupies when engaged with the fastener (120).

The fastener catch (122) of FIGS. 3A-B includes an exemplary first actuation feature (172). The exemplary first actuation feature (172) of FIGS. 3A-B is a physical attribute related to the geometry of the fastener catch (122) that is used to actuate the fastener catch (122). In FIGS. 3A-B, the fastener catch (122) is implemented as a prong. The prong is a thin, projecting part of the fastener catch (122) that extends toward the region where the remote actuator (142) is situated when engaged with the fastener (120).

In FIGS. 3A-B, the actuator head (146) includes a second actuation feature (174). The exemplary second actuation feature (174) of FIGS. 3A-B is a physical attribute related to the geometry of the remote actuator (142) that is used to actuate the fastener catch (122). In this manner, the second actuation feature (174) of FIGS. 3A-B corresponds with the first actuation feature (172). The second actuation feature (174) of FIGS. 3A-B is implemented as slot along the flange of the exemplary actuator head (146) in FIGS. 3A-B. The slot in FIGS. 3A-B receives the prong when the actuator head (142) is engaged with the fastener (120). The interaction between the prong and the slot toggle the fastener catch (122) in the example of FIGS. 3A-B between the first position and the second position as the prong moves along the actuation slot when the actuator head (142) is engaged with the fastener (120).

When the first actuation feature (172) and the second actuation feature (174) of FIGS. 3A-B are configured in an engaged orientation with respect to one another, the first actuation feature (172) and the second actuation feature (174) place the fastener catch (122) in the first position whereby the fastener catch (122) is pressed into the region in which the tail (116 on FIG. 1) of a flexible connecter (112 on FIG. 1) occupies when engaged with the fastener (120). When the first actuation feature (172) and the second actuation feature (174) of FIGS. 3A-B are configured in an released orientation, the first actuation feature (172) and the second actuation feature (174) place the fastener catch (122) in the second position whereby the fastener catch (122) is pushed away from the region in which the tail (116 on FIG. 1) of a flexible connecter (112 on FIG. 1) occupies when engaged with the fastener (120).

Figure 4:
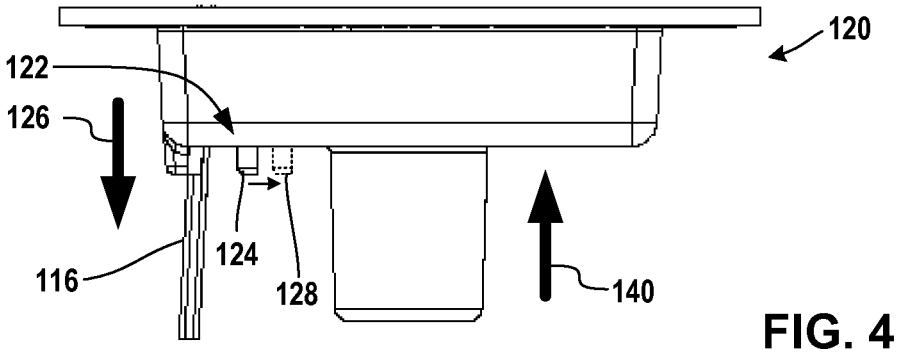
FIG. 4 sets forth a drawing illustrating the exemplary fastener useful in the removable air duct sealing system of FIG. 1 for obstructing airflow through portions of an air duct system according to embodiments of the present invention.
Figure 5:
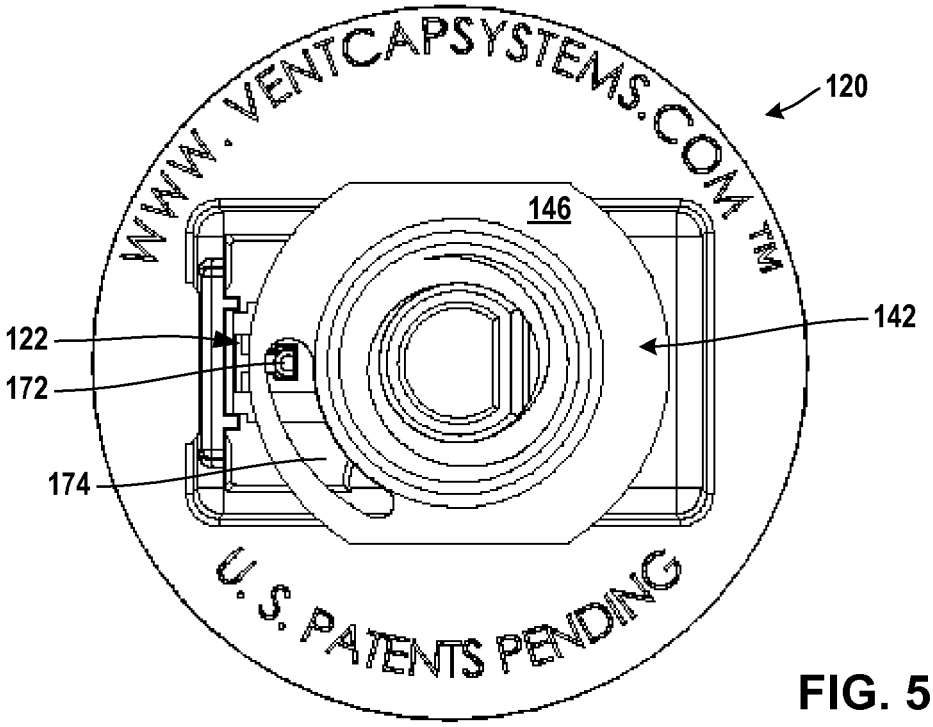
FIG. 5 sets forth a drawing illustrating the exemplary fastener and the exemplary remote actuator useful in the removable air duct sealing system of FIG. 1 for obstructing airflow through portions of an air duct system according to embodiments of the present invention.
Figure 6:
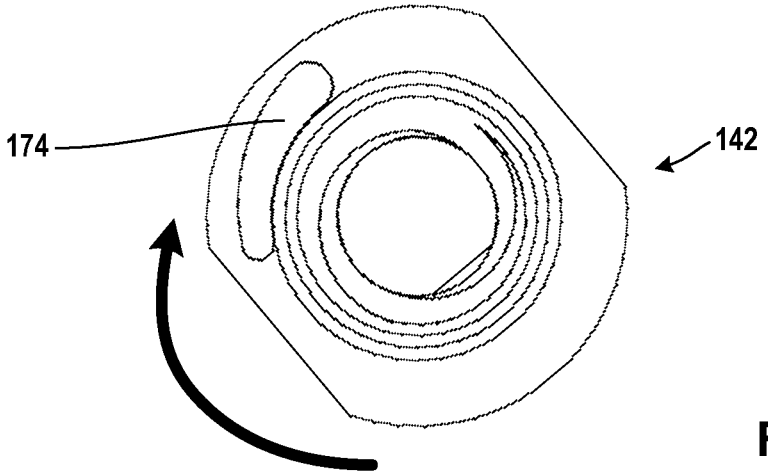
FIG. 6 sets forth a drawing illustrating the exemplary remote actuator of FIG. 5 turned clock-wise approximately forty-five degrees.
Figure 7A:
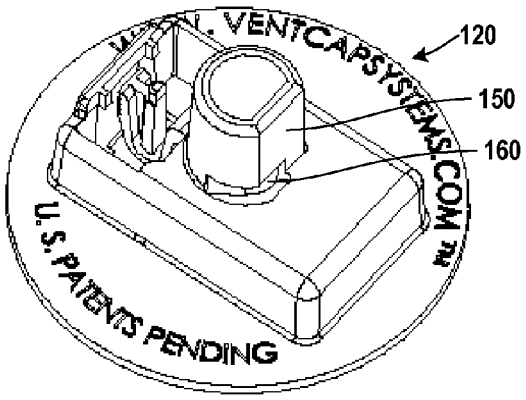
FIG. 7A sets forth a drawing illustrating the exemplary fastener useful in the removable air duct sealing system of FIG. 1 for obstructing airflow through portions of an air duct system according to embodiments of the present invention.
Figure 7B:
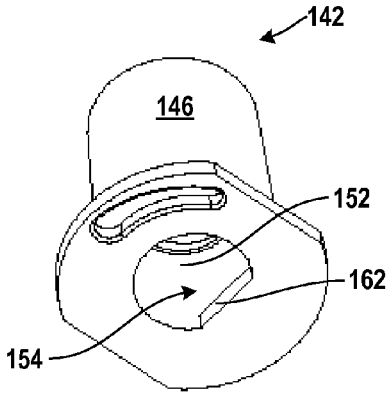
FIG. 7B sets forth a drawing illustrating the exemplary remote actuator useful in the removable air duct sealing system of FIG. 1 for obstructing airflow through portions of an air duct system according to embodiments of the present invention.
Figure 7C:
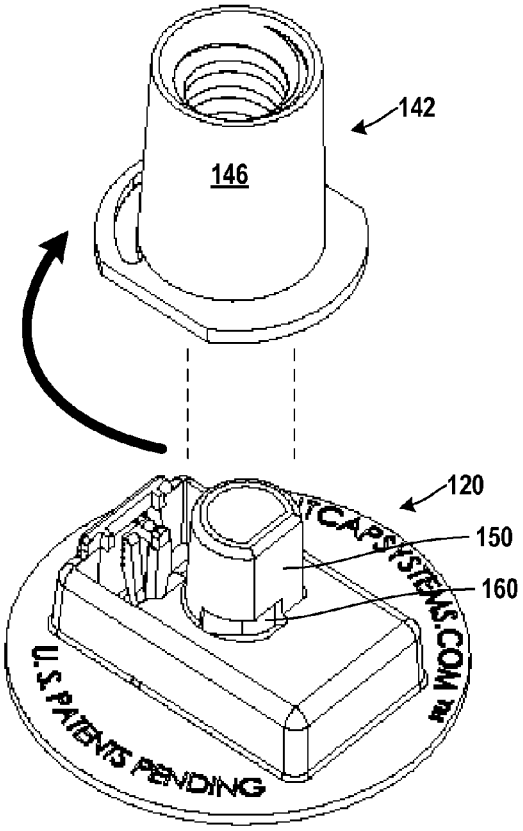
FIG. 7C sets forth a drawing illustrating the exemplary fastener and the exemplary remote actuator useful in the removable air duct sealing system of FIG. 1 for obstructing airflow through portions of an air duct system according to embodiments of the present invention.
Figure 7D:
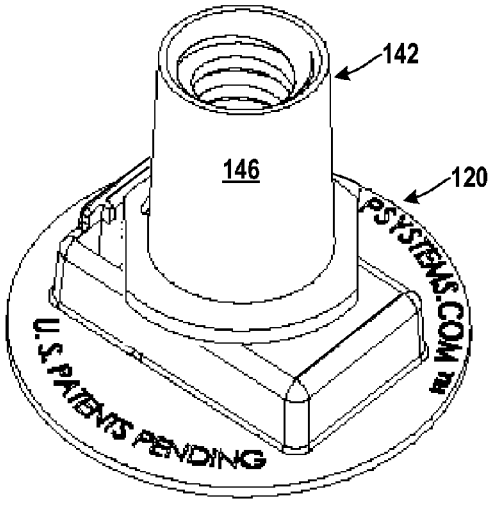
FIG. 7D sets forth a drawing illustrating the exemplary fastener and the exemplary remote actuator useful in the removable air duct sealing system of FIG. 1 for obstructing airflow through portions of an air duct system according to embodiments of the present invention.

For further explanation with regard to the interaction between the prong and the slot to toggle the fastener catch (122) in the example of FIGS. 3A-B, consider FIGS. 4-6. FIG. 4 sets forth a drawing illustrating the exemplary fastener (120) useful in the removable air duct sealing system (100) of FIG. 1 for obstructing airflow through portions of an air duct system according to embodiments of the present invention. The fastener catch (122) of the fastener (120) in the example of FIG. 4 is capable of being configured in a first position (124) that prevents the fastener (120) from moving in a first direction (126) along the tail (116) relative to the flexible connector (not shown in its entirety, but only a portion of the tail 116), but does allow the fastener (120) of FIG. 4 to move in a second direction (140). While placing the fastener catch (122) in the first position (124) illustrated in FIG. 4 prevents the fastener (120) from moving in the first direction (126), placing the fastener catch (122) in a second position (128) that allows the fastener (120) to move in the first direction (126) along the tail (116). When placed in the second position (128), the fastener catch (122) disengages from the tail (116), thereby allowing the fastener (120) to slide freely along the tail (116) in the example of FIG. 4.

In the example of FIG. 4, the default position of the fastener catch (122) is in the first position (124). The fastener catch (122) of FIG. 4 defaults to this position because the fastener catch (122) is held in place by a cantilever spring (shown at 138 in FIG. 2C), which is under less tension when the fastener catch (122) is configured in the first position (124) than when the fastener catch (122) is configured in the second position (128).

Turning to FIG. 5, FIG. 5 sets forth a drawing illustrating the exemplary fastener (120) and the exemplary remote actuator (142) useful in the removable air duct sealing system (100) of FIG. 1 for obstructing airflow through portions of an air duct system according to embodiments of the present invention. FIG. 5 illustrates how the exemplary fastener (120) and the exemplary remote actuator (142) may be designed so that the two components (120, 142) work together to actuate the fastener catch (122) when the fastener (120) and the remote actuator (142) are engaged. The remote actuator (142) of FIG. 5 has an actuator head (146) configured on the fastener (120) in a manner so as to align the actuation feature (172) of the fastener catch (122) with the actuation feature (174) of the actuator (142). Specifically in the example of FIG. 5, the actuation feature (172) of the fastener catch (122) is a prong and the actuation feature (174) of the remote actuator (142) is a slot. The prong fits into the slot when the remote actuator (142) of FIG. 5 is engaged with the fastener (120). In the configuration shown in FIG. 5, the slot allows the fastener catch (122) to remain in the first position (shown as 124 on FIG. 4).

FIG. 6 sets forth a drawing illustrating the exemplary remote actuator (142) of FIG. 5 turned clock-wise approximately forty-five degrees (45°). Rotating the remote actuator (142) as depicted in FIG. 6 with respect to the fastener (120) shown in FIG. 5 also rotates the actuation feature (174) of the remote actuator (142). As the slot rotates with the remote actuator (142), the prong (described above with reference to FIG. 5) of the fastener catch (122) is forced by the wall of the slot to move inward toward the center of rotation of the remote actuator (142). This movement increases the tension on the cantilever spring (shown at 138 in FIG. 2C) and moves the fastener catch (122) from the first position (shown as 124 on FIG. 4) to the second position (shown as 128 on FIG. 4).

In this manner, the exemplary remote actuator (142) of FIGS. 5 and 6 is configured to allow a user to selectively place the fastener catch (122) in either of the first position (124) and the second position (128) in dependence upon the positioning of the remote actuator (142) relative to the fastener catch (shown at 122 in FIG. 5) when the remote actuator (142) is engaged with the fastener (120). That is, the actuation feature (172) of the fastener (120) in FIG. 5 and the actuation feature (174) of the remote actuator (142) in FIGS. 5 and 6 are capable of placing the fastener catch (122) in the first position (shown as 124 in FIG. 4) when the first actuation feature (172) and the second actuation feature (174) are configured in an engaged orientation (shown in FIG. 5). When the actuation feature (172) and the actuation feature (174) are configured in a released orientation (shown as the fastener (120) in FIG. 5 and the remote actuator (142) of FIG. 6), the actuation feature (172) and the actuation feature (174) capable of placing the fastener catch (122) in the second position (shown as 128 in FIG. 4).

FIGS. 3B and 5 illustrates an exemplary remote actuator (142) engaged with an exemplary fastener (120) according to embodiments of the present invention. For further explanation of how an exemplary actuator may engage with an exemplary fastener according to embodiments of the present invention, FIGS. 7A-D set forth drawings illustrating the exemplary fastener (120) and the exemplary remote actuator (142) useful in the removable air duct sealing system (100) of FIG. 1 for obstructing airflow through portions of an air duct system according to embodiments of the present invention.

The exemplary fastener (120) of FIGS. 7A-D includes a raised engagement region (150). The raised engagement region (150) of FIGS. 7A-D is a geometric feature of the fastener (120) that forms an interface for the remote actuator (142) to mount or connect to the fastener (120). In the example of FIGS. 7A-D, the raised engagement region (150) has the shape of a circle with a chord region removed—resembling the letter "C". The fastener (120) of FIGS. 7A-D includes a locking feature (160) that is implemented in this example as a notch. The locking feature (160) in the example of FIGS. 7A-D is a geometric attribute of the fastener (120) that interlocks with a corresponding locking feature on the remote actuator to help keep the remote actuator (142) connected to the faster (120) when the two components are engaged.

In the examples of FIGS. 7A-D, the actuator head (146) includes a recessed engagement region (152). The recessed engagement region (152) of FIGS. 7A-D is a geometric attribute of the remote actuator (142) that forms an interface for the remote actuator (142) to mount or connect to the fastener (120). In the example of FIGS. 7A-D, recessed engagement region (152) is capable of receiving the raised engagement region (150) to engage the fastener (120) with the actuator head (146). That is, in the example of FIGS. 7A-D, the raised engagement region (150) fits inside the recessed engagement region (152).

To ensure that the actuator head (146) of FIGS. 7A-D is properly oriented when placed on the fastener (120), the recessed engagement region (152) includes an opening (154). The opening (154) for the actuator head (146) of FIGS. 7A-D is configured to correspond with the shape of the raised engagement region (150) to restrict the initial orientation of the actuator head (146) relative to the fastener (120) when the remote actuator (142) initially engages with the fastener (120). To correspond with the shape of the raised engagement region (150), the opening (154) in the example of FIGS. 7A-D is shaped like a circle with a chord region removed—again, much like the letter "C".

One will note, in the example of FIGS. 7A-D, that the shape of the actuator head (146) changes when passing from the opening (154) further into the recessed engagement region (152). The circumference of the recessed engagement region (152) transitions from a "C" shaped to a circular shape. This transition with respect to the circumference of the recessed engagement region (152) in the example of FIGS. 7A-D forms an edge inside the recessed engagement region (152) just past the opening (154) that can interlock with the edge created by the locking feature (160) (implemented as a notch in this example) when the remote actuator (142) is turned clockwise. In this manner, the transition in the circumference of the recessed engagement region (152) from circumference at the opening (154) to the circumference deeper inside the recessed engagement region (152) forms a locking feature (162) in the actuator head (146) in the example of FIGS. 7A-D that is implemented as a detent.

This locking feature (162) of the actuator head (146) in FIGS. 7A-D corresponds with the locking feature (160) of the fastener (120). The locking feature (160) of the fastener (120) and the locking feature (162) of the remote actuator (142) allow the fastener (120) and the actuator head (146) to disengage when the locking feature (160) of the fastener (120) and the locking feature (162) of the actuator head (146) are configured in an unlocked orientation (see orientation in FIG. 7C). In turn, however, the locking feature (160) of the fastener (120) and the locking feature (162) of the remote actuator (142) prevent the fastener (120) and the actuator head (146) from disengaging when the locking feature (160) of the fastener (120) and the locking feature (162) of the remote actuator (142) are configured in a locked orientation (see orientation shown in FIG. 7D). In the example of FIGS. 7A-D, the actuator head (146) and the fastener (120) transition from the unlocked orientation (see orientation in FIG. 7C) to the locked orientation (see orientation in FIG. 7D) by rotating the actuator head (146) approximately forty-five degrees (45°) clockwise while the actuator head (146) is engaged with the fastener (120) Likewise, in the example of FIGS. 7A-D, the actuator head (146) and the fastener (120) may transition from the locked orientation (see orientation in FIG. 7D) to the unlocked orientation (see orientation in FIG. 7C) by rotating the actuator head (146) approximately forty-five degrees (45°) counter-clockwise.

Figure 8:
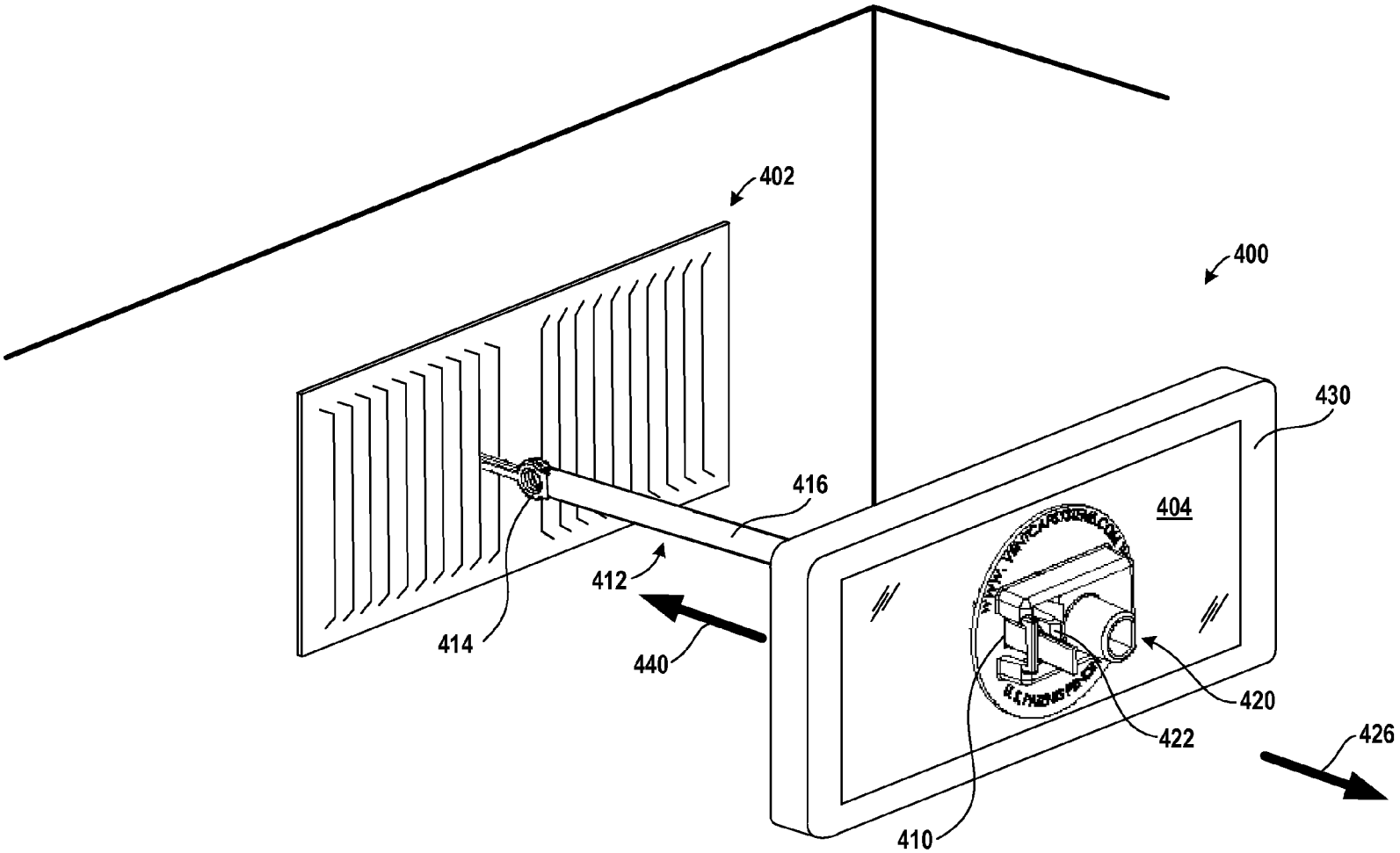
FIG. 8 sets forth a drawing illustrating a perspective view of an exemplary air duct blocking device for obstructing airflow through portions of an air duct system according to embodiments of the present invention during the installation of the air duct sealing device over an air vent register.

FIG. 8 sets forth a drawing illustrating a perspective view of an exemplary air duct sealing system (400) for obstructing airflow through portions of an air duct system according to embodiments of the present invention during the installation of the air duct sealing system (400) over an air vent register (402). The removable air duct sealing system (400) of FIG. 8 includes a support plate (404) having a first side and a second side. The support plate (404) of FIG. 8 has an opening (410) extending through the support plate (404) from the first side to the second side.

In the example of FIG. 8, the removable air duct sealing system (400) includes a flexible connector (412). The flexible connector (412) of FIG. 8 has a catch (414) and a tail (416). The catch (414) of FIG. 8 is capable of connecting the flexible connector (412) to an air duct register. The tail (416) of FIG. 8 capable of passing through the opening (410) in the support plate (404) and passes through a fastener (420).

The removable air duct sealing system (400) of FIG. 8 includes a fastener (420) operatively connected to the support plate (404). The fastener (420) of FIG. 8 has a fastener catch (422). The fastener (420) in the example of FIG. 8 is capable of interacting with the tail (416) of the flexible connector (412) in dependence upon the positioning of the fastener catch (422). The fastener catch (422) of FIG. 8 is capable of being configured in an engaged position that prevents the fastener (420) from moving in a direction (426) along the tail (416) away from the catch (414) of the flexible connector (412), but that allows the fastener (420) to move in the opposite direction (440) toward the catch (414) along the tail (416). The fastener catch (422) of FIG. 8 is, however, capable of being configured in release position that allows the fastener (420) to move in the direction (426) along the tail (416).

To ensure that the maximum amount of air is blocked between the air vent register and the support plate (404), the removable air duct sealing system (400) of FIG. 8 includes a gasket (430). The gasket (430) of FIG. 8 is configured on the first side of the support plate (404). The gasket (430) is capable of restricting airflow between the support plate (404) and an air duct system component (418) when the gasket (430) is pressed toward the air duct register (402).

Figure 9:
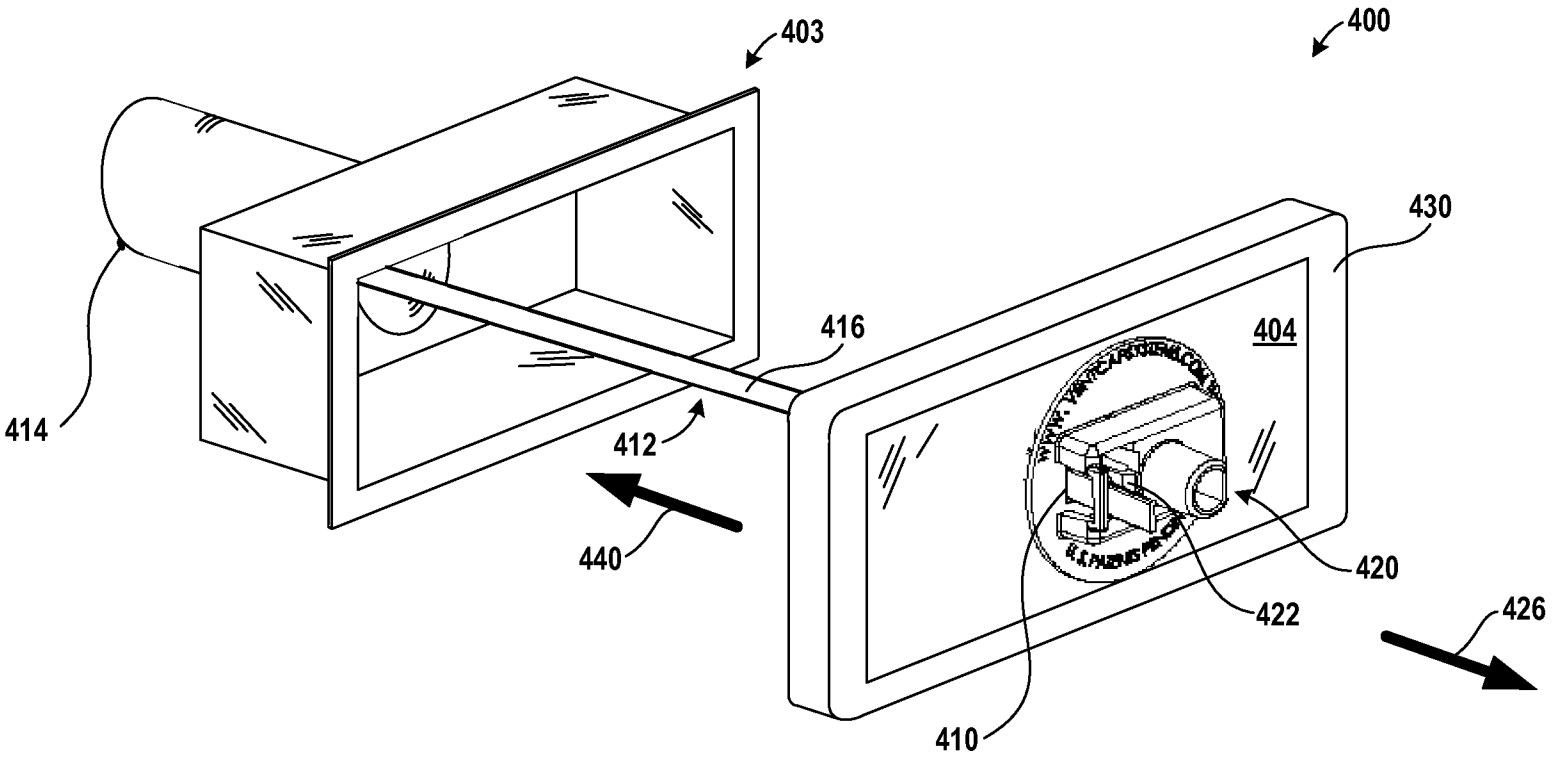
FIG. 9 sets forth a drawing illustrating a perspective view of an exemplary air duct sealing system for obstructing airflow through portions of an air duct system according to embodiments of the present invention during the installation of the air duct sealing system over a register boot.

FIG. 9 sets forth a drawing illustrating a perspective view of an exemplary air duct sealing system (400) for obstructing airflow through portions of an air duct system according to embodiments of the present invention during the installation of the air duct sealing system (400) over a register boot (403). The exemplary air duct sealing system (400) of FIG. 9 is similar to the exemplary air duct sealing system (400) of FIG. 8 and therefore all of constituent parts of the exemplary air duct sealing system (400) of FIG. 9 are described with reference to FIG. 8.

Figure 10:
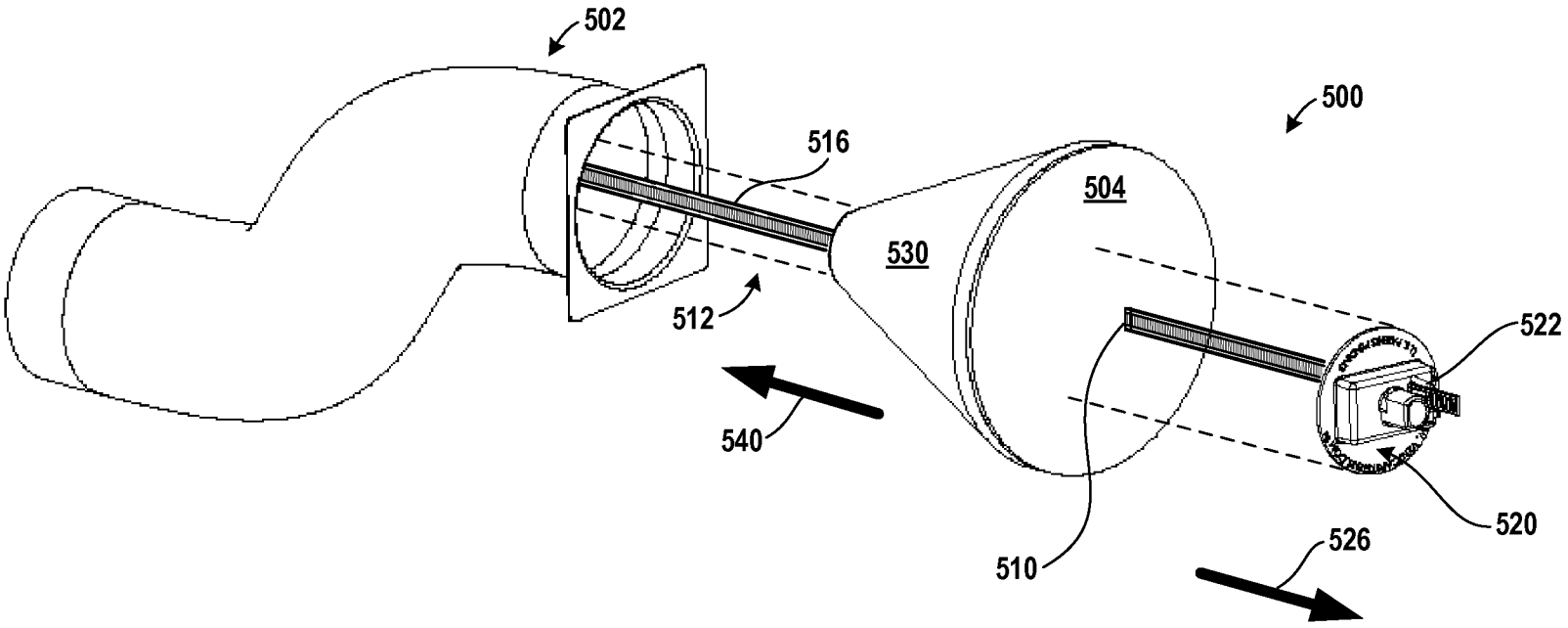
FIG. 10 sets forth a drawing illustrating a perspective, exploded view of an exemplary air duct sealing system for obstructing airflow through portions of an air duct system according to embodiments of the present invention during the installation of the air duct sealing system over an open air vent duct.

FIG. 10 sets forth a drawing illustrating a perspective, exploded view of an exemplary air duct sealing system (500) for obstructing airflow through portions of an air duct system according to embodiments of the present invention during the installation of the air duct sealing system (500) over an open air vent duct (502). It is advantageous for technicians to be able to seal off air ducts during construction projects because often the installation of the air handling/conditioning system occurs during the middle of the construction project timeline. Leaving the air ducts open during the remainder of the construction invites debris and other contaminants to settle inside the air duct system. The removable air duct sealing system (500) of FIG. 10 includes a support plate (504) having a first side and a second side. The support plate (504) of FIG. 10 has an opening (510) extending through the support plate (504) from the first side to the second side.

In the example of FIG. 10, the removable air duct sealing system (500) includes a flexible connector (512). The flexible connector (512) of FIG. 10 has a catch (not shown) and a tail (516). The catch (not shown) of FIG. 10 is capable of connecting the flexible connector (512) to the air duct at a joint or register boot or any other place as will occur to those of skill in the art. The tail (516) of FIG. 10 is capable of passing through the opening (510) in the support plate (504) and passes through a fastener (520).

The removable air duct sealing system (500) of FIG. 10 includes a fastener (520) operatively connected to the support plate (504). The fastener (520) of FIG. 10 has a fastener catch (522). The fastener (520) in the example of FIG. 10 is capable of interacting with the tail (516) of the flexible connector (512) in dependence upon the positioning of the fastener catch (522). The fastener catch (522) of FIG. 10 is capable of being configured in an engaged position that prevents the fastener (520) from moving in a direction (526) along the tail (516) away from the catch (514) of the flexible connector (512), but that allows the fastener (520) to move in the opposite direction (540) toward the catch (514) along the tail (516). The fastener catch (522) of FIG. 10 is, however, capable of being configured in release position that allows the fastener (520) to move in the direction (526) along the tail (516).

To ensure that the maximum amount of air is blocked between the air duct and the support plate (504), the removable air duct sealing system (500) of FIG. 10 includes a gasket (530). In the example of FIG. 10, the gasket (530) has a conical shape to snugly fit into the air duct (502). The gasket (530) of FIG. 10 is configured on the first side of the support plate (504). The gasket (530) is capable of restricting airflow between the support plate (504) and an air duct system component (518) when the gasket (530) is pressed toward the air duct register (502).

Figure 11:
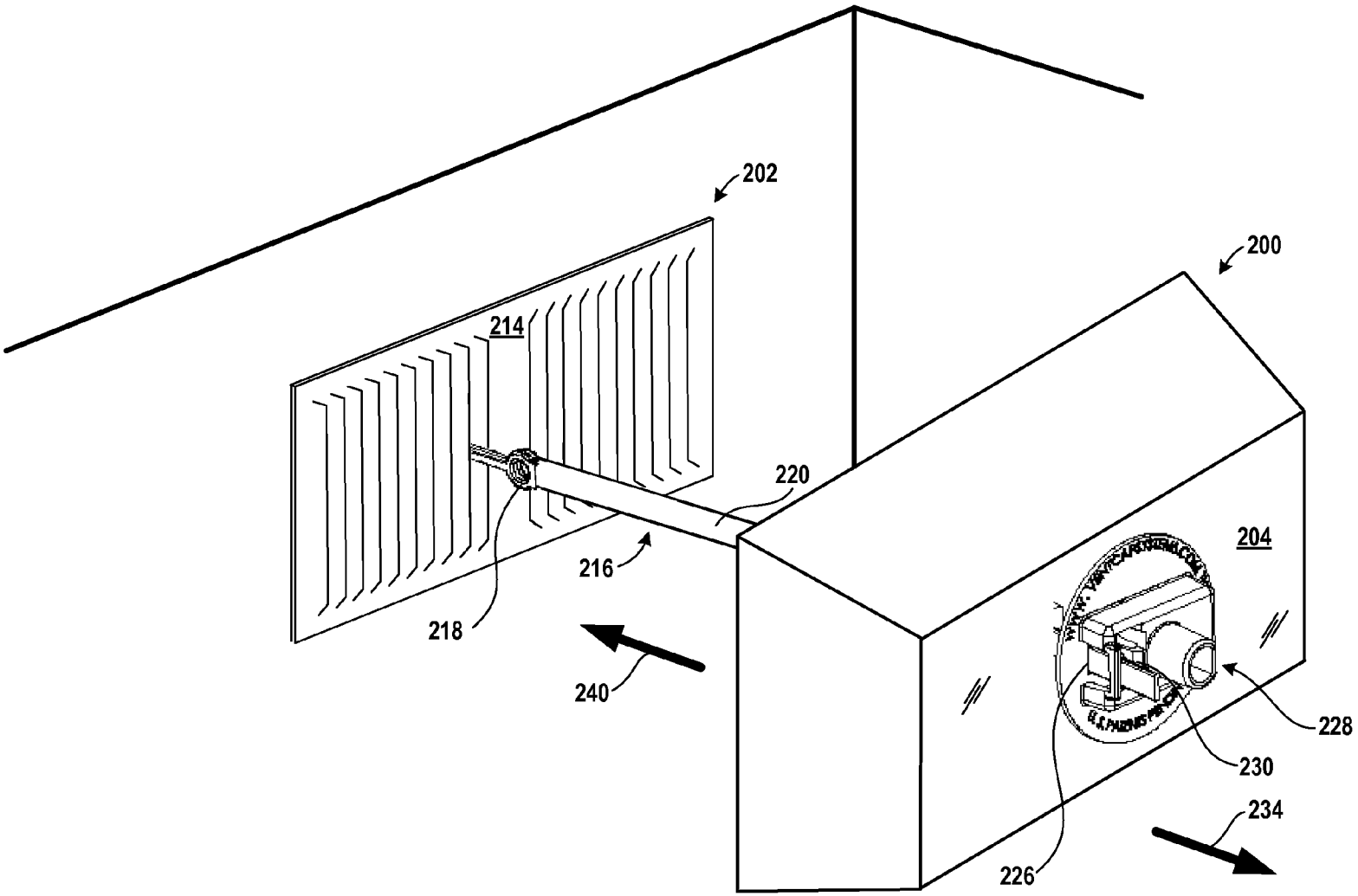
FIG. 11 sets forth a drawing illustrating a perspective, exploded view of an exemplary air duct sealing system for obstructing airflow through portions of an air duct system according to embodiments of the present invention.

FIG. 11 sets forth a drawing illustrating a perspective, exploded view of an exemplary air duct sealing system (200) for obstructing airflow through portions of an air duct system (202) according to embodiments of the present invention. The air duct sealing system (200) of FIG. 11 includes a cover assembly (204) having a first side and a second side. The cover assembly (204) of FIG. 11 has an opening (226) extending through the cover assembly (204) from the first side to the second side. In the example of FIG. 11, the cover assembly (204) is capable of restricting airflow between the cover assembly (204) and an air duct system component (214) when the cover assembly (204) is pressed toward the air duct system component (214).

The air duct sealing system (200) of FIG. 11 includes a flexible connector (216). The flexible connector (216) of FIG. 11 has a catch (218) and a tail (220). The catch (218) is capable of connecting the flexible connector (216) to the air duct system component (214) such as, for example, an air vent register, register boot, or any other component as will occur to those of skill in the art. The tail (220) of the flexible connector (216) in the example of FIG. 11 includes various notches (not visible in FIG. 11). The tail (220) of FIG. 11 is capable of passing through the opening (226) in the cover assembly (204).

The cover assembly (204) of FIG. 11 includes a fastener (228). The fastener (228) and the tail (220) of the flexible connector (216) in the example of FIG. 11 are capable of operating together as a ratchet. The fastener (228) of FIG. 11 includes a ratchet pawl (230) that is capable of engaging at least one of the notches of the tail (220) of the flexible connector (216) to prevent the fastener (228) from moving in a direction (234) away from the catch (218) of the flexible connector (216) along the tail (220) when the ratchet pawl (230) is configured in an engaged position, but allow the fastener (228) to move in a direction (240) toward the catch (218) along the tail (220). When the ratchet pawl (230) is configured in a released position, the ratchet pawl (230) of FIG. 11 allows the notches of the tail (220) to slide past the fastener (228), thereby allowing the fastener (228) to move in the direction (234) along the tail (220).

Figure 12:
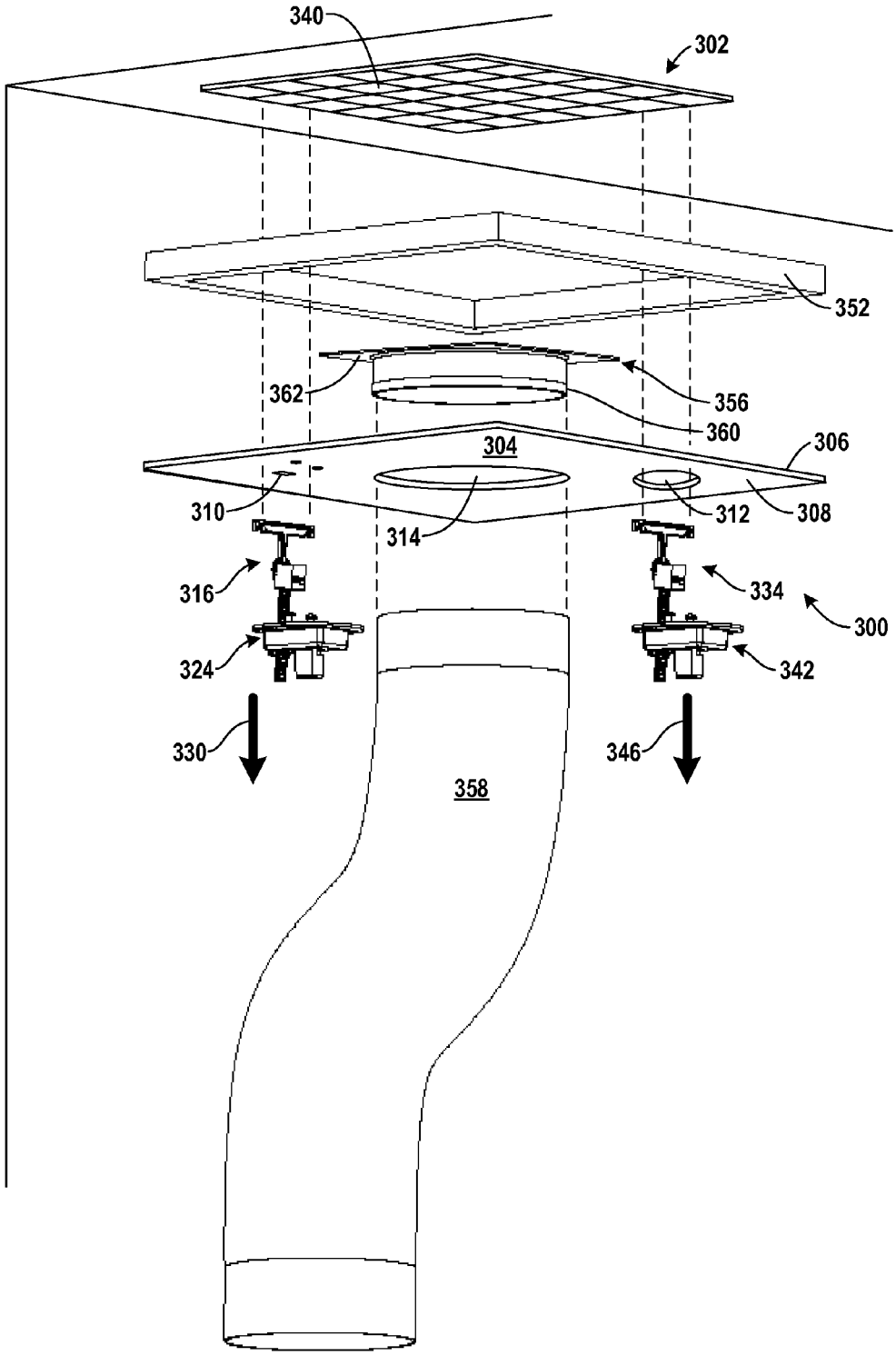
FIG. 12 sets forth a drawing illustrating a perspective, exploded view of an exemplary removable air duct sealing system for directing airflow through portions of an air duct system according to embodiments of the present invention.

In addition to obstructing airflow through portions of an air duct system, some embodiments of the present invention may actually be utilized to direct or channel the airflow through an air duct system. FIG. 12 sets forth a drawing illustrating a perspective, exploded view of an exemplary removable air duct sealing system (300) for directing airflow through portions of an air duct system (302) according to embodiments of the present invention. The embodiment in the example of FIG. 12 may be used to connect to an air duct pressurization or depressurization system such as, for example, the Minneapolis Duct Blaster® or the Retrotec Duct Testing Blower System.

The removable air duct sealing system (300) of FIG. 12 includes a support plate (304) having a first side (306) and a second side (308). The support plate (304) of FIG. 12 has a first opening (310), a second opening (312), and a third opening (314). Each of the first opening (310), the second opening (312), and the third opening (314) extending through the support plate (304) from the first side (306) to the second side (308).

The removable air duct sealing system (300) of FIG. 12 includes a first flexible connector (316). The first flexible connector (316) of FIG. 12 has a catch and a tail. The catch of the first flexible connector (316) is capable of connecting the first flexible connector (316) to an air duct system component (340) in the example of FIG. 12. The tail of the first flexible connector (316) is capable of passing through the first opening (310) in the support plate (304).

To secure the support plate (304) to the first flexible connector (316), the removable air duct sealing system (300) of FIG. 12 includes a first fastener (324) operatively connected to the support plate (304). The first fastener (324) has a first fastener catch that is capable of interacting with the tail of the first flexible connector (316) in dependence upon the positioning of the fastener catch. The fastener catch of FIG. 12 is capable of being configured in an engaged position that prevents the first fastener (324) from moving in a first direction (330) along the first tail (322) relative to the first flexible connector (316), but the first fastener catch is capable of being configured in a second position that allows the first fastener (324) to move in the direction (330) along the tail of the flexible connector (316). The first fastener (324) in the example of FIG. 12 is mounted in a fixed position relative to the support plate (304) for stability.

Due to the size of the support plate (304)—which must be large enough to support a gasket or large enough on its own to seal an air duct component—the example of FIG. 12 includes a second flexible connector (334) and a second fastener (342). Both of the fasteners (324 and 342) and both of the flexible connectors (316 and 334) may operate similarly to the other fasteners and flexible connectors described herein with respect to the other Figures and embodiments. Moreover, the remote actuators useful in those other removable air duct sealing systems according to embodiments of the present invention may also be used with the fasteners and flexible connectors described with reference to FIG. 12.

The second flexible connector (334) of FIG. 12 has a catch and a tail as described above. The catch of the second flexible connector (334) is capable of connecting the second flexible connector (334) to the air duct system component (340) in the example of FIG. 12. Further, the tail of the second flexible connector (334) in the example of FIG. 12 is capable of passing through the second opening (312) in the support plate (304).

The second fastener (342) of FIG. 12 is operatively connected to the support plate (304) and has a fastener catch. The fastener catch of the second fastener (342) of FIG. 12 is capable of interacting with the tail of the second flexible connector (334) in dependence upon the positioning of the fastener catch, which may occur in the manner described above with reference to the other Figures or in any other manner as will occur to those of skill in the art. The fastener catch of the second fastener (342) in the example of FIG. 12 is capable of being configured in a position that prevents the second fastener (342) from moving in a direction (346) away from the catch of the second flexible connector (334) along the tail of the second flexible connector (334). The second fastener (342) in the example of FIG. 12, however, is capable of being configured in another position that allows the second fastener (342) to move in the direction (346) away from the catch and along the tail of the second flexible connector (334).

The removable air duct sealing system (300) of FIG. 12 includes a gasket (352) configured on the first side (306) of the support plate (304). The gasket (352) of FIG. 12 is capable of restricting air flow between the support plate (304) and the air duct system component (340) when the gasket (352) is pressed toward the air duct system component (340).

In the example of FIG. 12, the removable air duct sealing system (300) includes a sleeve (356) positioned at the third opening (314). The sleeve (356) in the example of FIG. 12, includes an flange (360) that—when the sleeve (356) is placed in position in the third opening (314)—extends away from the support plate (304) on the second side (308) to provides a surface for connecting to an air duct hose (358). The air duct hose (358) of FIG. 12 may be attached to the flange (360) by a Velcro® belt, a clamp, or any other fastener as will occur to those of skill in the art. To support the weight of the air duct hose (358) and facilitate the firm attachment of the hose (358) to the removable air duct sealing system (300)

of FIG. 12, the sleeve (356) includes a another flange (362) that is positioned adjacent to the first side (306) of the support plate (304) and prevents the sleeve (356) from falling through the third opening (314). Although the sleeve (356) in the example of FIG. 12 is shown as a separate detachable component from the air duct sealing system (300) of FIG. 12, those of skill in the art will recognize that the sleeve could be an integral component of the support plate (304) as well.

While certain exemplary embodiments have been described in details and shown in the accompanying drawings, it is to be understood that such embodiments are merely illustrative of and not devised without departing from the basic scope thereof, which is determined by the claims that follow.

What I claim is:

1. A removable air duct sealing system for obstructing airflow through portions of an air duct system, the removable air duct sealing system comprising:

a support plate having a first side and a second side, the support plate having an opening extending through the support plate from the first side to the second side;

a flexible connector, the flexible connector having a catch and a tail, the catch capable of connecting the flexible connector to an air duct system component, the tail capable of passing through the opening in the support plate;

a fastener operatively connected to the support plate, the fastener having a fastener catch, the fastener capable of interacting with the tail of the flexible connector in dependence upon the positioning of the fastener catch, the fastener catch capable of being configured in a first position that prevents the fastener from moving in a first direction along the tail relative to the flexible connector, the fastener catch capable of being configured in a second position that allows the fastener to move in the first direction along the tail relative to the flexible connector;

a gasket configured on the first side of the support plate, the gasket capable of restricting airflow between the support plate and an air duct system component when the gasket is pressed toward the air duct system component; and a remote actuator capable of allowing a user to press the gasket toward the air duct system component when the remote actuator is engaged with the fastener, the remote actuator comprising an actuator head and an extension rod, wherein the remote actuator is configured to allow the user selectively place the fastener catch in either of the first position and the second position in dependence upon the positioning of the remote actuator relative to the fastener catch when the remote actuator is engaged with the fastener.

2. The removable air duct sealing system of claim 1 wherein the remote actuator is configured to allow the user to toggle the fastener catch between the first position and the second position by rotating the remote actuator relative to the fastener catch when the remote actuator is engaged with the fastener.

3. A removable air duct sealing system for obstructing airflow through portions of an air duct system, the removable air duct sealing system comprising:

a support plate having a first side and a second side, the support plate having an opening extending through the support plate from the first side to the second side;

a flexible connector, the flexible connector having a catch and a tail, the catch capable of connecting the flexible connector to an air duct system component, the tail capable of passing through the opening in the support plate;

a fastener operatively connected to the support plate, the fastener having a fastener catch, the fastener capable of interacting with the tail of the flexible connector in dependence upon the positioning of the fastener catch, the fastener catch capable of being configured in a first position that prevents the fastener from moving in a first direction along the tail relative to the flexible connector, the fastener catch capable of being configured in a second position that allows the fastener to move in the first direction along the tail relative to the flexible connector;

a gasket configured on the first side of the support plate, the gasket capable of restricting airflow between the support plate and an air duct system component when the gasket is pressed toward the air duct system component; and a remote actuator capable of allowing a user to press the gasket toward the air duct system component when the remote actuator is engaged with the fastener, the remote actuator comprising an actuator head and an extension rod; and wherein:

the fastener comprises a raised engagement region; and the actuator head comprises a recessed engagement region capable of receiving the raised engagement region to engage the fastener with the actuator head.

4. The removable air duct sealing system of claim 3 wherein:

the raised engagement region having a first shape; and the recessed engagement region comprising a recessed engagement region opening, the recessed engagement region opening having a second shape corresponding with the first shape of the raised engagement region to restrict the initial orientation of the actuator head relative to the fastener when the remote actuator initially engages with the fastener.

5. The removable air duct sealing system of claim 3 wherein:

the fastener comprises a first locking feature; and the actuator head comprises a second locking feature, the second locking feature corresponding with the first locking feature, the second locking feature and the first locking feature capable of allowing the fastener and the actuator head to disengage when the first locking feature and the second locking feature are configured in an unlocked orientation, the second locking feature and the first locking feature capable of preventing the fastener and the actuator head from disengaging when the first locking feature and the second locking feature are configured in a locked orientation.

6. The removable air duct sealing system of claim 5 wherein:

the first locking feature of the fastener comprises a locking notch; and the second locking feature of the actuator head comprises an actuator detent.

7. A removable air duct sealing system for obstructing airflow through portions of an air duct system, the removable air duct sealing system comprising:

a support plate having a first side and a second side, the support plate having an opening extending through the support plate from the first side to the second side;

a flexible connector, the flexible connector having a catch and a tail, the catch capable of connecting the flexible connector to an air duct system component, the tail capable of passing through the opening in the support plate;

a fastener operatively connected to the support plate, the fastener having a fastener catch, the fastener capable of interacting with the tail of the flexible connector in dependence upon the positioning of the fastener catch, the fastener catch capable of being configured in a first position that prevents the fastener from moving in a first direction along the tail relative to the flexible connector, the fastener catch capable of being configured in a second position that allows the fastener to move in the first direction along the tail relative to the flexible connector;

a gasket configured on the first side of the support plate, the gasket capable of restricting airflow between the support plate and an air duct system component when the gasket is pressed toward the air duct system component; and a remote actuator capable of allowing a user to press the gasket toward the air duct system component when the remote actuator is engaged with the fastener, the remote actuator comprising an actuator head and an extension rod, and wherein:

the fastener catch comprises a first actuation feature; and the actuator head comprises a second actuation feature, the second actuation feature corresponding with the first actuation feature, the first actuation feature and the second actuation feature capable of placing the fastener catch in the first position when the first actuation feature and the second actuation feature are configured in an engaged orientation, the first actuation feature and the second actuation feature capable of placing the fastener catch in the second position when the first actuation feature and the second actuation feature are configured in an released orientation.

8. The removable air duct sealing system of claim 7 wherein:

the first actuation feature is a prong;

the second actuation feature is a actuation slot, the actuation slot capable of receiving the prong when the actuator head is engaged with the fastener, the prong and the actuation slot capable of toggling the fastener catch between the first position and the second position as the prong moves along the actuation slot when the actuator head is engaged with the fastener.

* * * * *